US006299222B1

(12) United States Patent
Atmodimedjo

(10) Patent No.: US 6,299,222 B1
(45) **Date of Patent: *Oct. 9, 2001**

(54) LATCHBOLT

(75) Inventor: Ruud S. Atmodimedjo, Apeldoorn (NL)

(73) Assignee: Emhart Inc., Newark, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/035,003

(22) Filed: Mar. 5, 1998

(30) Foreign Application Priority Data

Mar. 8, 1997 (GB) ..... 9704831

(51) Int. Cl.[7] ..... E05C 1/06

(52) U.S. Cl. ..... 292/144; 292/192; 70/107; 70/141

(58) Field of Search ..... 292/63–66, 57, 292/71, 167, 144, 201, DIG. 25, 6, 58, 60, 61, 192, 169.14; 70/277, 278, 279, 107, 110, 111, 125, 127, 141, 470

(56) References Cited

U.S. PATENT DOCUMENTS 885,559 * 4/1908 Woodward ..... 292/198
1,323,007 * 11/1919 Brunette ..... 292/144
1,413,830 * 4/1922 Cudera .
2,910,859 * 11/1959 Allen ..... 70/135
3,767,238 * 10/1973 Zawadzki ..... 292/21
4,573,333 * 3/1986 Choi ..... 70/279
4,784,415 * 11/1988 Malaval ..... 292/144
4,902,053 * 2/1990 Hakkarainen ..... 292/144
5,083,448 * 1/1992 Karkainen ..... 70/227
5,085,475 * 2/1992 Austin ..... 292/92
5,100,184 * 3/1992 Schmitt ..... 292/144

FOREIGN PATENT DOCUMENTS 2203794 10/1988 (GB) .

* cited by examiner

*Primary Examiner*—Gary Estremsky
(74) *Attorney, Agent, or Firm*—Spencer T. Smith; John D. del Ponti

(57) ABSTRACT

A lockset mechanism having a latchbolt assembly adapted for manual and remote operation is provided. The latchbolt assembly includes a latchbolt tail and a latchbolt head pivotally mounted for relative movement on the latchbolt tail. A slide mounted on the latchbolt tail is moveable for selectively engaging the latchbolt head to permit pivoting of the latchbolt head relative to the latchbolt tail. A spring biases the slide towards the position which engages the slide. A solenoid is operably coupled to the slide for actuation thereof.

15 Claims, 4 Drawing Sheets

LATCHBOLT

The present invention relates to an improved latchbolt, and in particular to a latchbolt which is suitable for remote operation, for example electronically.

Electrical and electronic locks comprising latch bolts and dead bolts are known, for use in commercial premises such as shops, hotels and offices. They have not so far been used, to any significant extent, in domestic premises because of the high cost of manufacture and the high cost and complexity of installation. Known electric and electronic locks have the disadvantage that they require a supply of mains electricity to the latch bolt, within the door in which it is installed, and this means that such locks have not so far been suitable for installation in domestic premises.

It is an advantage of electronic locks that they are adapted for operation by means of a remote control device, and this advantage is not currently available in locks which are suitable for general domestic installation.

It is an object of the present invention to provide a latchbolt, and a lock comprising a latchbolt, in which the above disadvantages are reduced or substantially obviated.

The present invention provides a latchbolt which comprises (i) a latchbolt tail and (ii) a latchbolt head, mounted on the latchbolt tail, and pivotable relative to the tail, characterised in that the latchbolt further comprises (iii) stop means forming part of the latchbolt head;

(iv) blocking means, mounted on the latchbolt tail for movement relative to the latchbolt tail, between a first position in which the blocking means engages the stop means to prevent pivoting of the latchbolt head and a second position in which the stop means is not engaged and the latchbolt head is free to pivot relative to the latchbolt tail and (v) biasing means biasing the blocking means towards the first position.

The present invention further provides a latchbolt assembly which comprises (A) a latchbolt which comprises (i) a latchbolt tail constrained to move between an obstruction position and a release position; and (ii) a latchbolt head, mounted on the latchbolt tail, and pivotable relative to the tail;

(B) biasing means biasing the latchbolt towards the obstruction position and (C) means operative to displace the latchbolt from the obstruction position towards the release position against the biasing means characterised in that the latchbolt assembly further comprises (iii) stop means forming part of the latchbolt head;

(iv) blocking means, mounted on the latchbolt tail for movement relative to the latchbolt tail, between a first position in which the blocking means engages the stop means to prevent pivoting of the latchbolt head and a second position in which the stop means is not engaged and the latchbolt head is free to pivot relative to the latchbolt tail and (v) biasing means biasing the blocking means towards the first position.

In a preferred embodiment of a latchbolt assembly according to the invention the assembly further comprises means operative to displace the blocking means from the first position towards the second position against the biasing means. The means operative to displace the blocking means from the first position towards the second position against the biasing means preferably comprises a solenoid.

The latchbolt assembly according to the present invention is particularly suitable for incorporation in a lockset, which preferably also contains a deadbolt, which may be either mechanically or electrically operated.

A lockset including a preferred embodiment of a latchbolt assembly according to the invention will now be described with reference to the accompanying drawings, in which FIG. 1 is a view of a lockset including a latchbolt assembly and a deadbolt assembly, with the latchbolt in the obstruction position and the deadbolt in the release position;

Figure 1:
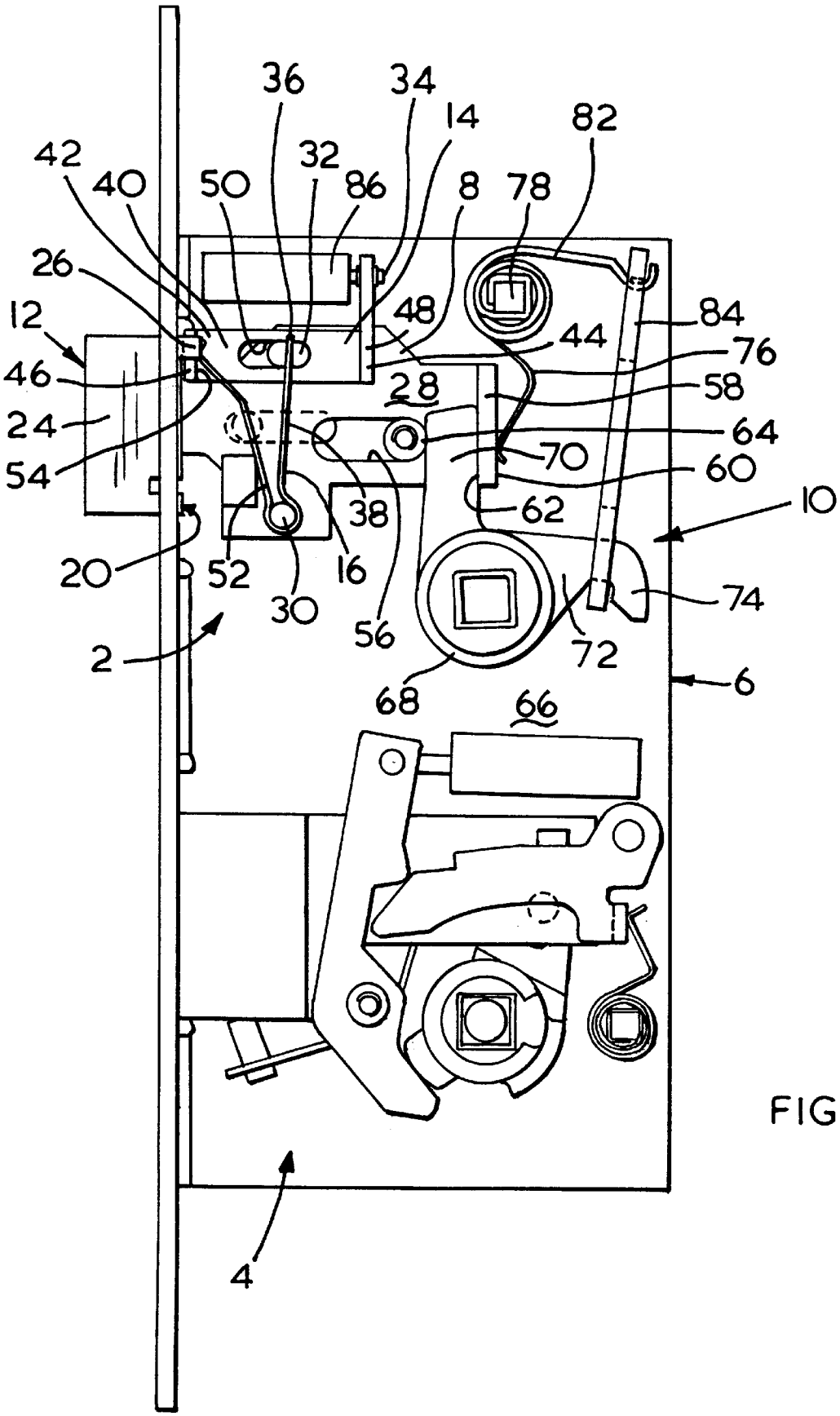
Figure 5:
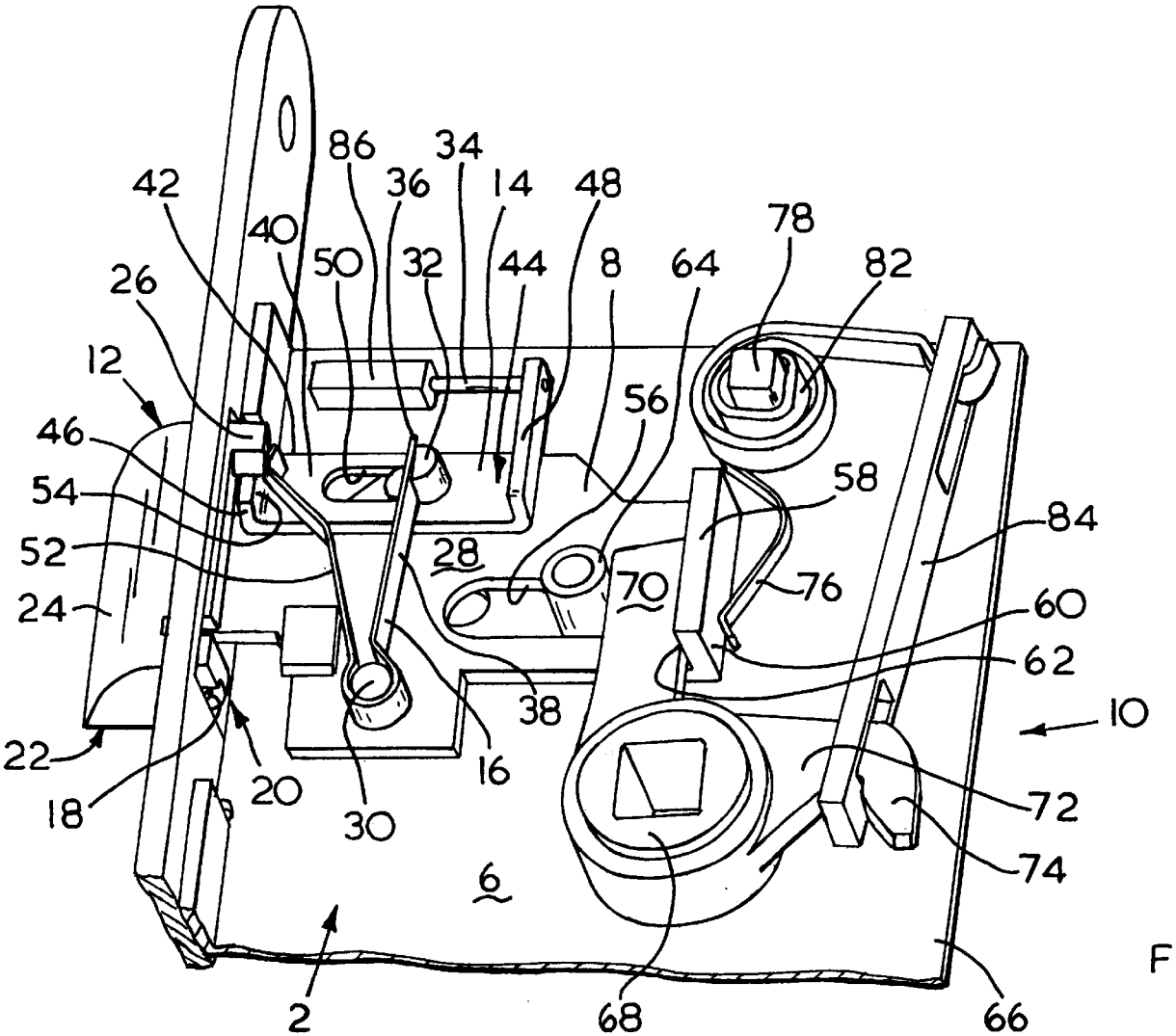
FIG. 5 is a partial perspective view of the latchbolt assembly of the lockset of FIG. 1 in the obstruction position as shown in FIGS. 1 and 2.

As can be seen from FIGS. 1 and 5, a lockset shown generally at 10, comprises a latchbolt assembly 2 and a deadbolt assembly 4 located within a housing 6.

Figure 6:
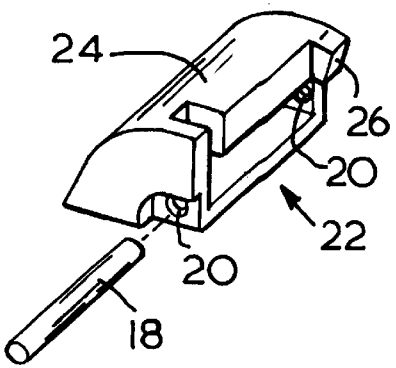
FIG. 6 is a perspective view of the latchbolt head, showing its construction in detail.

The latchbolt assembly 2 comprises a latchbolt tail 8, latchbolt head 12, slide 14 and spring 16. The latchbolt head 12 is mounted on the latchbolt tail 8 by means of an axle pin 18 (see FIG. 6) received in two supports (20) and is free to pivot relative to the latchbolt tail 8. The latchbolt head 12 is generally in the form of a quarter segment of a cylinder, having an inner mounting face, an outer plane face 22 and a curved face which curved face forms the strike face 24 of the latchbolt head 12. A stop 26 is formed integrally with the latchbolt head 12 and projects into the housing 6 from the inner mounting face 20, towards the latchbolt tail 8.

The latchbolt tail 8 comprises a plate section 28 from which two bosses 30, 32 project. A generally V-shaped leaf spring 16 is located around the boss 30, with the end 36 (remote from the boss 30) of one leg 38 of the spring 16 engaging the boss 32.

The slide 14 comprises an elongated plate 40, each short end 42, 44 of which terminates in an upstanding portion 46,48. An elongated slot 50 is formed in the slide 14 for receiving the boss 32. When the slide 14 is mounted on the latchbolt tail 8 by projection of the boss 32 through the slot 50, and the leaf spring 16 is located around the boss 30, the second leg 52 of the leaf spring 16 contacts the inner face 54 of the upstand 46.

The upstand 48 terminates in an extension portion extending in a plane perpendicular to the plane of the slider 14 away from the latchbolt tail 8 and provides a mounting for a pin 34.

The latchbolt tail 8 further comprises an elongated slot 56 and terminates at the end remote from the latchbolt head 12 in an upstand portion 58, which upstand has a spring contact face 60 and a hub crank arm contact face 62.

The latchbolt tail 8 is mounted in the housing by means of a boss 64 which projects from the back plate 66 of the housing 6 and engages in the elongated slot 56 of the latchbolt tail 8.

A hub crank 68 is also mounted on the housing back plate 66, for operation by a lever (not shown) and comprises a first arm 70 which projects into the area above the plate section 28 of the latchbolt tail 8 and engages the hub crank arm contact face 62 of the upstand portion 58 of the latchbolt tail 8. The hub crank 68 further comprises a second arm 72 which terminates in a hook section 74. A first coiled spring 76 is mounted on a further boss 78 projecting from the back plate 66 of the housing 6, and contacts the spring contact face 60 of the upstand portion 58 of the latchbolt tail 8. A second coiled spring 82 is also mounted on the boss 78. A linkage 84 links the arm 72 of the hub crank with the second coiled spring 82.

The latchbolt assembly 2 further comprises a solenoid 86 for receiving the pin 34 mounted on the extension portion of the upstand 48.

The lockset 10 further comprises a deadbolt assembly shown generally at 4, which may be any conventional mechanically or electronically operated deadbolt. By way of example, the deadbolt 4 shown in FIGS. 1 to 4 is a conventional electronically operated deadbolt.

In operation, the latchbolt assembly 2 can be operated either mechanically or electronically. In order to describe the mechanical operation, reference will be made in particular to FIGS. 1 and 3.

Figure 2:
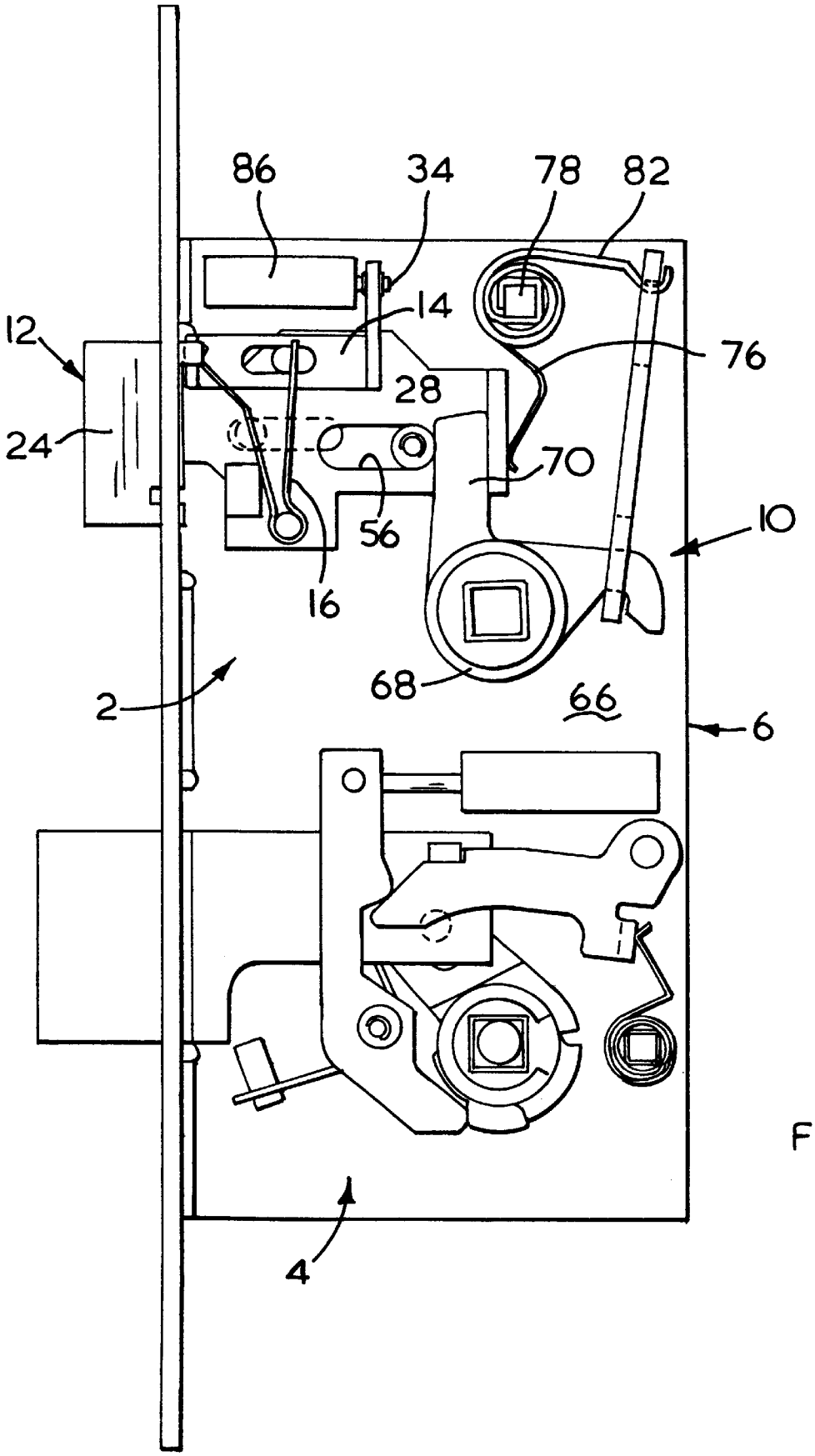
FIG. 2 is a view of the lockset according to FIG. 1 with both the latchbolt and the deadbolt in the obstruction position.
Figure 3:
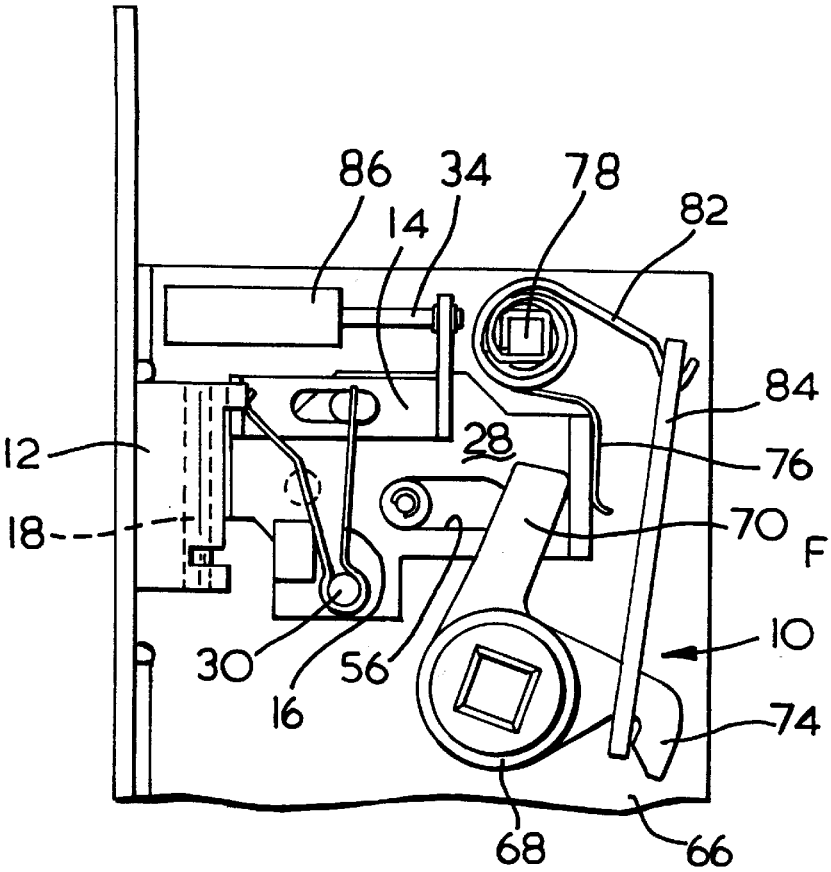
FIG. 3 is a view of part of the lockset according to FIG. 1 with the latchbolt in the release position.

For mechanical operation, the operating lever (not shown) which is attached to the hub crank 68 is rotated in a clockwise direction, as shown in FIGS. 1 to 4, thus rotating the first arm 70 from the position shown in FIG. 1 to the position shown in FIG. 3. The arm 70 is in contact with the hub arm contact face 62 of the upstand portion 58, as described above, and rotation of the arm 70 drives the latchbolt tail 8 against the biasing force of the coiled spring 76. In FIGS. 1 to 3, the slide 14 is shown in its first position, in which it engages the stop 26 and prevents pivoting of the latchbolt head 12 relative to the latchbolt tail 8. The complete latchbolt sub-assembly, comprising the latchbolt tail 8, latchbolt head 12, slide 14 and spring 16 is thus driven as a single component against the biasing force of the coiled spring 76 from the obstruction position of FIG. 1 to the release position of FIG. 3. When the operating lever (not shown) is released, the latch is returned to the obstruction position of FIG. 1 under the biasing force of the coiled spring 76. In mechanical operation, therefore, the latchbolt operates in the same manner as a conventional mechanical latchbolt. As has been stated above, the latchbolt assembly 2 can be operated either mechanically or electronically. In order to describe the electronic operation, reference will be made in particular to FIGS. 1 and 4.

Figure 4:
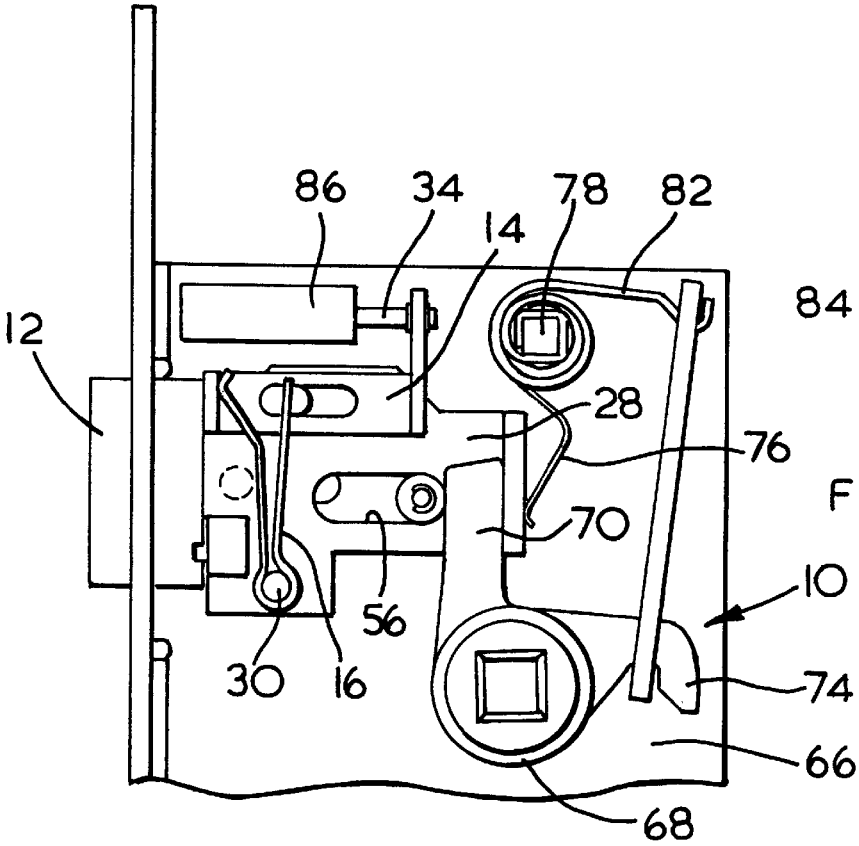
FIG. 4 is a view of part of the lockset according to FIG. 1 with the latchbolt in the obstruction position, the blocking means being disengaged from the stop means.

When the latchbolt is operated electronically, by means of a transponder controlled by an operator, the solenoid 86 is activated to drive the slide 14 against the biasing force of leaf spring 16, from the position relative to the latchbolt tail 8 which has been described above as the first position, as shown in FIG. 1, into the position relative to the latchbolt tail 8 which has been described above as the second position, as shown in FIG. 4. The stop 26 of the latchbolt head 12 is no longer blocked by the upstand 46 of the slide 14 and the latchbolt head 12 is free to pivot relative to the latchbolt tail 8.

Where the lockset 10 is installed in a door, simple pressure on the door, when the latchbolt 2 and deadbolt 4 are in the positions shown in FIG. 4, allows the door to open. The slide 14 can be restored to the first position relative to the latchbolt tail 8 by mechanical operation of the operating lever (not shown) or by closing the door.

What is claimed is:

1. A latchbolt assembly operable in a manual mode of operation and a remote mode of operation, the latchbolt assembly comprising:

a housing;

a latchbolt including a tail slidably coupled to said housing for linear movement relative to said housing between a forward position and a rearward position and a head pivotally coupled to said tail for rotational movement relative to said tail between an extending position and a retracted position;

a blocking mechanism slidably coupled to said tail for sliding linear movement relative to said tail between a first position to engage said head for preventing said rotational movement of said head and a second position to disengage said head for permitting said rotational movement of said head;

a first actuation mechanism coupled to said tail and manually operable to slide said tail from said forward position to said rearward position such that said latchbolt including said tail and said head is slid into said housing as a single component without rotating said head relative to said tail; and a second actuation mechanism coupled to said blocking mechanism and remotely operable in response to a signal to move said blocking mechanism from said first position to said second position such that said head is permitted to rotate into said housing from said extended position to said retracted position without sliding said tail relative to said housing.

2. The latchbolt assembly of claim 1 wherein said head has a pair of supports extending from an inner mounting frame and receiving an axle pin for pivotally coupling said head to said tail.

3. The latchbolt assembly of claim 1 wherein said first actuation mechanism comprises:

a crank mounted for rotation on said housing and having an arm which engages said tail such that rotation of said crank in a first direction slides said tail from said forward position towards said rearward position; and a spring biasing said crank in a direction opposite said first direction.

4. The latchbolt assembly of claim 1 wherein said second actuation mechanism comprises a solenoid mounted on said housing and having a slide pin operably coupled to said blocking mechanism for moving said blocking mechanism between said locked position and said unlocked position in response to said signal.

5. The latchbolt assembly of claim 1 further comprising a spring operably disposed between said housing and said tail to urge said tail towards said first position.

6. The latchbolt assembly of claim 1 further comprising a deadbolt assembly located within said housing and having a deadbolt moveable between a locked position and an unlocked position.

7. A latchbolt assembly operable in a manual mode of operation and a remote mode of operation, the latchbolt assembly comprising:

a housing having a backplate and a boss projecting from said backplate; a latchbolt tail having a lost motion slot receiving said boss to slidably couple said latchbolt tail to said housing for relative linear movement between a forward position and a rearward position;

a manual actuator including a crank that is rotatably supported on said backplate and having an arm which engages said latchbolt tail such that manual rotation of said crank in a first direction slides said latchbolt tail from said forward position towards said rearward position;

a latchbolt head pivotally coupled to said latchbolt tail for rotational movement relative to said latchbolt tail between an extended position and a retracted position;

a slider having a lost motion slot receiving a post extending from said latchbolt tail to support said latchbolt tail between an extended position and a retracted position;

a slider having a lost motion slot receiving a post extending from said latchbolt tail to support said slider on said latchbolt tail for relative linear movement, said slider being positionable in a locked position wherein said slider engages said latchbolt head to prevent rotational movement of said latchbolt head relative to said latchbolt tail and a released position to permit rotation of aid latchbolt head relative to said latchbolt tail; and a remote actuator including an actuator mechanism mounted on said housing and responsive to a remote signal to position said slider from said locked position to said released position without sliding said latchbolt tail from said forward position toward said rearward position.

8. The latchbolt assembly of claim 7 further comprising a spring member having a first end secure to said housing and a second end coupled to said latchbolt tail to bias said latchbolt tail toward said forward position.

9. The latchbolt assembly of claim 7 further comprising a spring member having a first end secured to said housing and a second end coupled to said crank to bias said crank in a direction opposite said first direction.

10. The latchbolt assembly of claim 7 further comprising a spring member having a first end secured to said latchbolt tail and a second end operably coupled to said slider to bias said slider toward said locked position.

11. The latchbolt assembly of claim 7 wherein said actuator mechanism comiprises a solenoid having a slide pin operably coupled to said slider for positioning said slider between said locked position and said unlocked position in response to said remote signal.

12. The latchbolt assembly of claim 7 wherein said latchbolt head has a pair of supports extending from an inner mounting frame and receiving an axle pin for pivotally coupled said latchbolt head to said latchbolt tail.

13. The latchbolt assembly of claim 12 wherein said latchbolt head flihter comprises a stop projecting from said inner mounting face and engaging said slider when said slider is in said locked position to prevent rotational movement of said latchbolt head relative to said latchbolt tail.

14. The latchbolt assembly of claim 7 further comprising a deadbolt assembly located within said housing and having a deadbolt moveable between a locked position and an unlocked position.

15. A latchbolt assembly operable in a manual mode of operation and a remote mode of operation, the latchbolt assembly comprising:

a housing;

a latchbolt including a tail slidably coupled to said housing for linear movement relative to said housing between a forward position and a rearward position and a head pivotally coupled to said tail for rotational movement relative to said tail between an extending position and a retracted position;

a blocking mechanism slidably coupled to said tail for sliding linear movement relative to said tail between a first position to engage said head for preventing said rotational movement of said head and a second position to disengage said head for permitting said rotational movement of said head;

a first actuation mechanism coupled to said tail and manually operable to slide said tail from said forward position to said rearward position such that said latchbolt including said tail and said head is slid into said housing as a single component without rotating said head relative to said tail;

a second actuation mechanism coupled to said blocking mechanism and remotely operable in response to a signal to move said blocking mechanism from said first position to said second position such that said head is permitted to rotate into said housing from said extended position to said retracted position without sliding said tail relative to said housing; and a spring operably disposed between said tail and said blocking mechanism to urge said blocking mechanism towards said first position.

* * * * *